US010542835B1

(12) United States Patent
Suozzo

(10) Patent No.: US 10,542,835 B1
(45) Date of Patent: Jan. 28, 2020

(54) CURTAIN ROD MOUNTING ASSEMBLY

(71) Applicant: Anthony Suozzo, Purchase, NY (US)

(72) Inventor: Anthony Suozzo, Purchase, NY (US)

( * ) Notice: Subject to any disclaimer, the term of this patent is extended or adjusted under 35 U.S.C. 154(b) by 0 days.

(21) Appl. No.: 16/136,345

(22) Filed: Nov. 1, 2018

(51) Int. Cl.
*F16M 11/00* (2006.01)
*A47H 1/142* (2006.01)

(52) U.S. Cl.
CPC ..... *A47H 1/142* (2013.01)

(58) Field of Classification Search
CPC ..... A47H 1/13; A47H 1/00; A47G 1/16
See application file for complete search history.

(56) References Cited

U.S. PATENT DOCUMENTS 3,889,912 A 6/1975 Ray
4,226,395 A 10/1980 Bellinger
4,363,459 A * 12/1982 Holzer ..... E06B 9/323 248/257
4,684,095 A 8/1987 Athey
5,044,589 A * 9/1991 Milne ..... A47H 1/124 160/902
5,082,226 A 1/1992 Mahan
6,135,403 A * 10/2000 Goldstein ..... A47H 1/12 248/253
6,402,111 B1 * 6/2002 Stewart ..... A47B 21/0314 248/295.11
D478,804 S 8/2003 Titus
8,418,975 B1 4/2013 Burr
8,701,740 B2 4/2014 Navarro
2013/0043357 A1 * 2/2013 McLeod ..... A47G 1/16 248/207

* cited by examiner

*Primary Examiner* — Amy J. Sterling

(57) ABSTRACT

A curtain rod mounting assembly for mounting a curtain rod over a window includes a sleeve that is mountable to trim around a window. A pair of fasteners is each extendable through a respective one of the first and second apertures to engage the trim around the window. In this way the sleeve is retained on the trim having the sleeve is horizontally oriented. A bracket is slidably coupled to the sleeve and a receiver is removably coupled to the bracket. A hook is slidably coupled to the receiver such that the hook is spaceable a selected distance from the trim around the window thereby facilitating the hook to receive a curtain rod.

4 Claims, 4 Drawing Sheets

CURTAIN ROD MOUNTING ASSEMBLY

CROSS-REFERENCE TO RELATED APPLICATIONS

I hereby claim the benefit under 35 U.S.C. Section 119(e) of U.S. Provisional application 62/606,471 filed on Sep. 25, 2017.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to mounting devices and more particularly pertains to a new mounting device for mounting a curtain rod over a window.

BRIEF SUMMARY OF THE INVENTION

An embodiment of the disclosure meets the needs presented above by generally comprising a sleeve that is mountable to trim around a window. A pair of fasteners is each extendable through a respective one of the first and second apertures to engage the trim around the window. In this way the sleeve is retained on the trim having the sleeve is horizontally oriented. A bracket is slidably coupled to the sleeve and a receiver is removably coupled to the bracket. A hook is slidably coupled to the receiver such that the hook is spaceable a selected distance from the trim around the window thereby facilitating the hook to receive a curtain rod.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
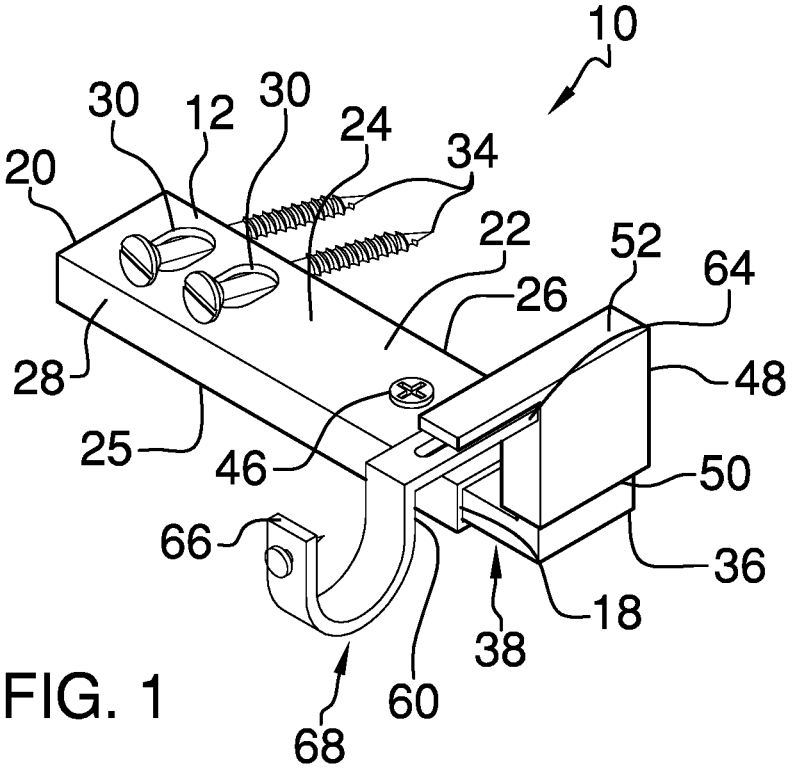
FIG. 1 is a top perspective view of a curtain rod mounting assembly according to an embodiment of the disclosure.
Figure 2:
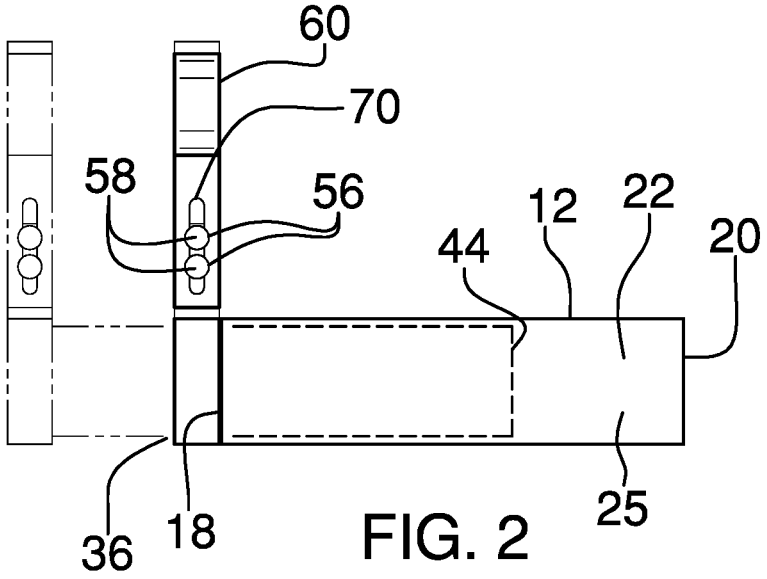
FIG. 2 is a bottom phantom view of an embodiment of the disclosure.
Figure 3:
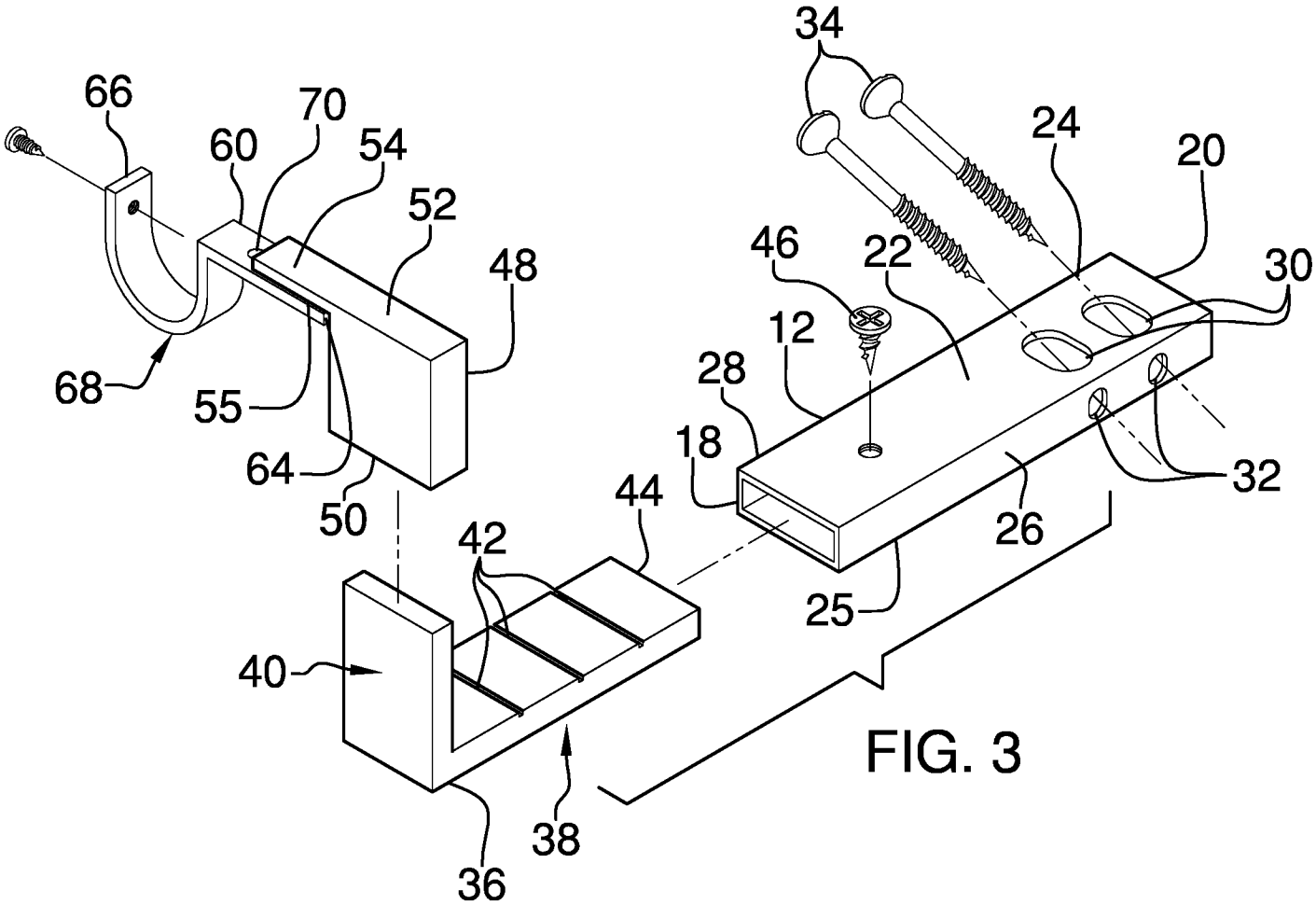
FIG. 3 is an exploded perspective view of an embodiment of the disclosure.
Figure 4:
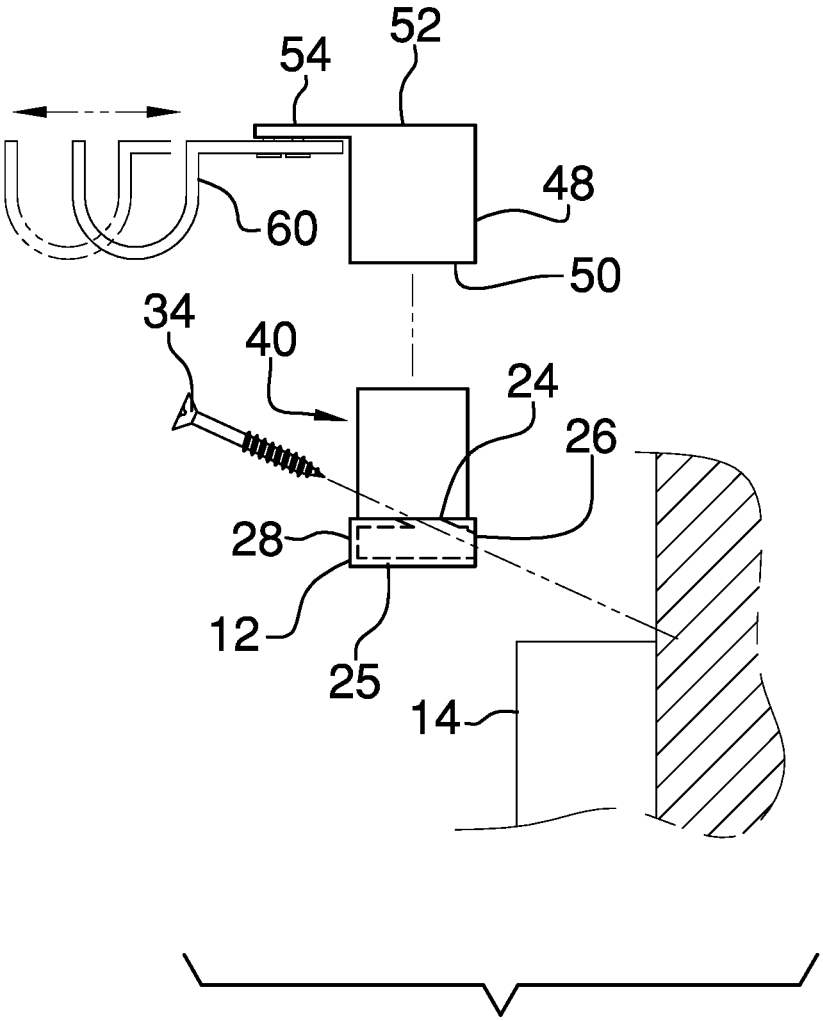
FIG. 4 is an exploded perspective in-use view of an embodiment of the disclosure.
Figure 5:
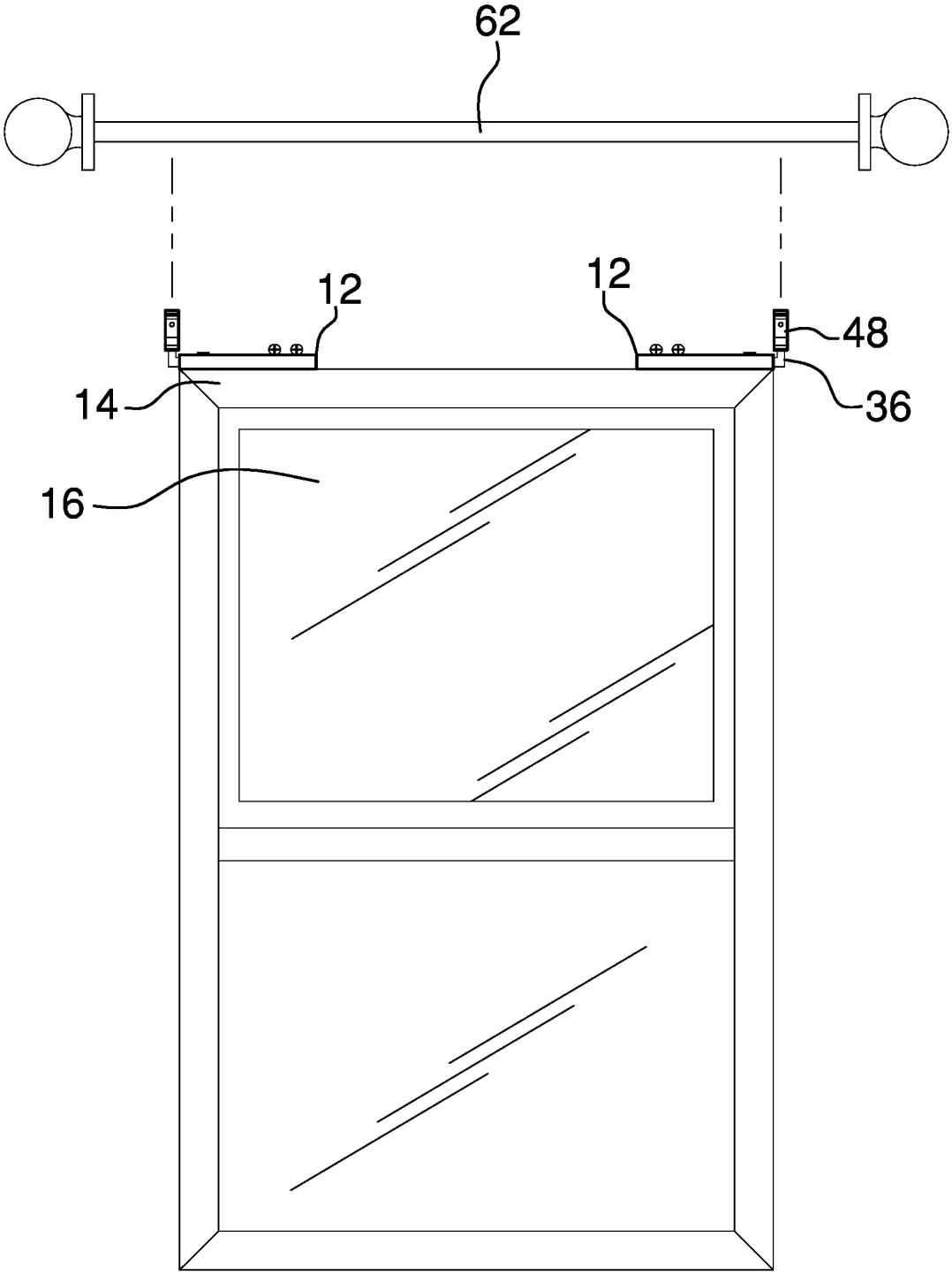
FIG. 5 is a perspective in-use view of an embodiment of the disclosure.

With reference now to the drawings, and in particular to FIGS. 1 through 5 thereof, a new mounting device embodying the principles and concepts of an embodiment of the disclosure and generally designated by the reference numeral 10 will be described.

As best illustrated in FIGS. 1 through 5, the curtain rod mounting assembly 10 generally comprises a sleeve 12 that is mountable above trim 14 around a window 16. Window 16 may be a window in a house, a commercial building or any other type of structure. Additionally, the trim 14 may be window casing of any conventional design. The sleeve 12 has a first end 18, a second end 20 and an outer wall 22 extending therebetween, and the outer wall 22 has a top side 24, a bottom side 25, a front side 26 and a back side 28.

The top side 24 has a pair of first fastener apertures 30 each extending into an interior of the sleeve 12. Each of the first fastener apertures 30 is elongated between the front 26 and back 28 sides of the outer wall 22 of the sleeve 12 such that each of the first fastener apertures 30 has an ovoid shape. The first fastener apertures 30 are spaced apart from each other and are distributed from the first end 18 toward the second end 20. The front side 26 has a pair of second fastener apertures 32 each extending into the interior of the sleeve 12. Each of the second fastener apertures 32 is aligned with a respective one of the first fastener apertures 30 and the front side 26 abuts a wall in which the window 16 is installed and the bottom side 25 of the sleeve 12 abuts the trim 14 around the window 16.

A pair of fasteners 34 is provided and each of the fasteners 34 is extendable through a respective one of the first 30 and second 32 fastener apertures to engage the trim 14 around the window 16. In this way the sleeve 12 is retained on the trim 14 having the sleeve 12 being horizontally oriented. Each of the fasteners 34 is positioned at an acute angle with the top side 24 of the sleeve 12 when the fasteners 34 are extended through the respective first 30 and second fastener apertures 32. In this way the weight bearing capacity of the fasteners 34 is enhanced.

A bracket 36 is provided and the bracket 36 is slidably coupled to the sleeve 12, and the bracket 36 has a first portion 38 forming a right angle with respect to a second portion 40. The first end 18 of the sleeve 12 slidably receives the first portion 38 of the bracket 36 having the second portion 40 being vertically oriented. The first portion 38 has a plurality of grooves 42 therein that are distributed between a distal end 44 of the first portion 38 and the second portion 40. A screw 46 is extended through the top side 24 of the outer wall 22 of the sleeve 12 and engages a selected one of the grooves 42 in the first portion 38 of the bracket 36. In this way the second portion 40 of the bracket 36 is retained a selected distance from the sleeve 12.

A receiver 48 is removably coupled to the bracket 36 and the receiver 48 has a bottom side 50 and a top side 52. The bottom side 50 is open, the receiver 48 is hollow and the bottom side 50 insertably receives the second portion 40 of the bracket 36. The top side 52 of the receiver 48 extends beyond a lateral boundary of the receiver 48 to define a peninsula 54 on the receiver 48 and the peninsula 54 has a downwardly facing surface 55. A pair of pins 56 is provided and each of the pins 56 is coupled to the downwardly facing surface 55 of the peninsula 54. Each of the pins 56 has a head 58 thereon that is spaced from the downwardly facing surface 55.

A hook 60 is slidably coupled to the receiver 48 such that the hook 60 is spaceable a selected distance from the trim 14 around the window 16. In this way the hook 60 can receive a curtain rod 62. The hook 60 has a primary end 64 and a secondary end 66, and the hook 60 has a concavely arcuate portion 68 adjacent to the secondary end 66 for receiving the curtain rod 62. The hook 60 has a slot 70 extending therethrough, and the slot 70 extends from the primary end 64 toward the concavely arcuate portion 68. Each of the pins 56 on the peninsula 54 extends through the slot 70 such that the hook 60 is slidably retained on the peninsula 54. Moreover, the head 58 on each of the pins 56 abuts the peninsula 54 to inhibit the peninsula 54 from is removed from the pins 56.

In use, the sleeve 12 is mounted on the trim 14 around the window 16 with the fasteners 34 such that the sleeve 12 is horizontally oriented above the window 16. The second portion 40 of the bracket 36 is slid into the first end 18 of the sleeve 12 and the screw 46 is extended through the screw 46 to engage the selected groove 42 in the second portion 40 of the bracket 36. The receiver 48 is positioned on the second portion 40 of the bracket 36 and the hook 60 is manipulated to slide the hook 60 a preferred distance from the wall. In this way the curtain rod 62 can be positioned over the window 16 and be spaced a selected distance away from the window 16. Thus, a curtain that is suspended from the curtain rod 62 can accommodate window sills and other protrusions associated with the window 16.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A curtain rod mounting assembly being configured to suspend a curtain rod a selected distance away from a window, said assembly comprising:

a sleeve being mountable above trim around a window, said sleeve having a first end, a second end and an outer wall extending therebetween, said outer wall having a top side, a bottom side, a front side and a back side, said top side having a pair of first fastener apertures each extending into an interior of said sleeve, each of said first fastener apertures being elongated between said front and back sides of said outer wall of said sleeve such that each of said first fastener apertures has an ovoid shape, said first fastener apertures being spaced apart from each other and being distributed from said first end toward said second end, said front side having a pair of second fastener apertures each extending into said interior of said sleeve, each of said second fastener apertures being aligned with a respective one of said first fastener apertures, said front side abutting a wall in which the window is installed having said bottom side abutting the trim around the window;

a pair of fasteners, each of said fasteners being extendable through a respective one of said first and second apertures to engage the trim around the window to retain said sleeve on the trim having said sleeve being horizontally oriented;

a bracket being slidably coupled to said sleeve, said bracket having a first portion forming a right angle with respect to a second portion, said first end of said sleeve slidably receiving said first portion of said bracket having said second portion being vertically oriented, said first portion having a plurality of grooves therein being distributed between a distal end of said first portion and said second portion;

a receiver being removably coupled to said bracket, said receiver having a bottom side and a top side, said bottom side being open, said receiver being hollow, said bottom side insertably receiving said second portion of said bracket, said top side extending beyond a lateral boundary of said receiver to define a peninsula on said receiver, said peninsula having a downwardly facing surface;

a pair of pins, each of said pins being coupled to said downwardly facing surface of said peninsula, each of said pins having a head thereon being spaced from said downwardly facing surface; and a hook being slidably coupled to said receiver such that said hook is spaceable a selected distance beyond the trim around the window thereby facilitating said hook to receive a curtain rod, said hook having a primary end and a secondary end, said hook having a concavely arcuate portion adjacent to said secondary end for receiving the curtain rod, said hook having a slot extending therethrough, said slot extending from said primary end toward said concavely arcuate portion, each of said pins on said peninsula extending through said slot such that said hook is slidably retained on said peninsula, said head on each of the pins abutting said peninsula to inhibit said peninsula from being removed from said pins.

2. The assembly according to claim 1, wherein each of said fasteners is positioned at an acute angle with said top side of said sleeve when said fasteners are extended through said respective first and second fastener apertures thereby enhancing weight bearing capacity of said fasteners.

3. The assembly according to claim 1, further comprising a screw being extended through said top side of said outer wall of said sleeve and engaging a selected one of said grooves in said first portion of said bracket thereby retaining said second portion of said bracket a selected distance from said sleeve.

4. A curtain rod mounting assembly being configured to suspend a curtain rod a selected distance away from a window, said assembly comprising:

a sleeve being mountable to trim around a window, said sleeve having a first end, a second end and an outer wall extending therebetween, said outer wall having a top side, a bottom side, a front side and a back side, said top side having a pair of first fastener apertures each extending into an interior of said sleeve, each of said first fastener apertures being elongated between said front and back sides of said outer wall of said sleeve such that each of said first fastener apertures has an ovoid shape, said first fastener apertures being spaced apart from each other and being distributed from said first end toward said second end, said front side having a pair of second fastener apertures each extending into said interior of said sleeve, each of said second fastener apertures being aligned with a respective one of said first fastener apertures, said front side abutting the trim around the window;

a pair of fasteners, each of said fasteners being extendable through a respective one of said first and second apertures to engage the trim around the window to retain said sleeve on the trim having said sleeve being horizontally oriented, each of said fasteners being positioned at an acute angle with said top side of said sleeve when said fasteners are extended through said respective first and second fastener apertures thereby enhancing weight bearing capacity of said fasteners;

a bracket being slidably coupled to said sleeve, said bracket having a first portion forming a right angle with respect to a second portion, said first end of said sleeve slidably receiving said first portion of said bracket having said second portion being vertically oriented, said first portion having a plurality of grooves therein being distributed between a distal end of said first portion and said second portion;

a screw being extended through said top side of said outer wall of said sleeve and engaging a selected one of said grooves in said first portion of said bracket thereby retaining said second portion of said bracket a selected distance from said sleeve;

a receiver being removably coupled to said bracket, said receiver having a bottom side and a top side, said bottom side being open, said receiver being hollow, said bottom side insertably receiving said second portion of said bracket, said top side extending beyond a lateral boundary of said receiver to define a peninsula on said receiver, said peninsula having a downwardly facing surface;

a pair of pins, each of said pins being coupled to said downwardly facing surface of said peninsula, each of said pins having a head thereon being spaced from said downwardly facing surface; and a hook being slidably coupled to said receiver such that said hook is spaceable a selected distance from the trim around the window thereby facilitating said hook to receive a curtain rod, said hook having a primary end and a secondary end, said hook having a concavely arcuate portion adjacent to said secondary end for receiving the curtain rod, said hook having a slot extending therethrough, said slot extending from said primary end toward said concavely arcuate portion, each of said pins on said peninsula extending through said slot such that said hook is slidably retained on said peninsula, said head on each of the pins abutting said peninsula to inhibit said peninsula from being removed from said pins.

* * * * *